US006072978A

United States Patent [19]

Wittmann

[11] Patent Number: 6,072,978

[45] Date of Patent: Jun. 6, 2000

[54] DEVICE FOR APPLYING RELEASE AGENT TO THE SURFACE OF A FIXING ROLLER OF AN ELECTROGRAPHIC PRINTER OR COPIER

[75] Inventor: Franz Wittmann, Isen, Germany

[73] Assignee: Oce Printing Systems GmbH, Poing, Germany

[21] Appl. No.: 09/117,317

[22] PCT Filed: Aug. 6, 1996

[86] PCT No.: PCT/DE96/01471

§ 371 Date: Jul. 27, 1998

§ 102(e) Date: Jul. 27, 1998

[87] PCT Pub. No.: WO97/27517

PCT Pub. Date: Jul. 31, 1997

[30] Foreign Application Priority Data

Jan. 26, 1996 [DE] Germany ..... 196 02 775

[51] Int. Cl.[7] ..... G03G 15/20

[52] U.S. Cl. ..... 399/325; 15/103.5; 118/260; 118/268; 399/326

[58] Field of Search ..... 15/103.5; 118/257, 118/260, 268; 399/325, 326

[56] References Cited

U.S. PATENT DOCUMENTS

| | | | |
|---|---|---|---|
| 3,324,791 | 6/1967 | Cassano et al. | 100/172 |
| 3,718,116 | 2/1973 | Thettu | 399/325 |
| 3,859,957 | 1/1975 | Larson | 399/326 |
| 4,182,263 | 1/1980 | Naeser et al. | 399/325 |
| 5,049,944 | 9/1991 | DeBolt et al. | 399/325 |
| 5,940,672 | 8/1999 | Kagawa | 399/325 |

FOREIGN PATENT DOCUMENTS

| | | |
|---|---|---|
| 0 480 666 | 4/1992 | European Pat. Off. . |
| 27 03 382 | 8/1978 | Germany . |
| 39 42 147 | 3/1991 | Germany . |
| 39 41 195 | 6/1991 | Germany . |

OTHER PUBLICATIONS

Japanese Abstract, JP05008900, vol. 17, No. 279, Jan. 19, 1993.

Japanese Abstract, JP61046965, vol. 10, No. 206, Mar. 7, 1986.

Japanese Abstract, JP63276079, vol. 13, No. 93, Nov. 14, 1998.

Japanese Abstract, JP 1214884, vol. 13, No. 527, Aug. 29, 1989.

*Primary Examiner*—Arthur T. Grimley
*Assistant Examiner*—William A. Noé
*Attorney, Agent, or Firm*—Hill & Simpson

[57] ABSTRACT

A printer or copier which operates by transfer printing has a fixing roller for affixing toner to the recording medium. A release agent, or parting oil, is applied to the roller by a dosing tube having openings through which the release agent flows to a wick. An application element is moved over the roller between the wick and the roller for cleaning and application of the release agent. The wick is held in guide elements and the lower guide element has a duct for collecting excess release agent and applying it to the application element.

10 Claims, 1 Drawing Sheet

DEVICE FOR APPLYING RELEASE AGENT TO THE SURFACE OF A FIXING ROLLER OF AN ELECTROGRAPHIC PRINTER OR COPIER

BACKGROUND OF THE INVENTION

1. Field of the Invention

The present invention is directed to a release agent applicator. The release agent applicator applies parting liquid onto the surface of a fixing drum of an electrographic printer or copier device working according to the transfer printing principle.

2. Description of the Related Art

In electrographic printer or copier devices, charge images are generated on a charge image carrier, for example on a photoconductor drum, these images are then inked with a developer mix in a developer station on the basis of electrostatic or magnetic forces. The inked charge images are transfer-printed onto a recording medium which is in the form of single sheets or continuous stock, for example, of paper, in a transfer printing station and are subsequently thermally fixed. For thermal fixing, U.S. Pat. No. 3,324,791 discloses that a fixing station be provided with two drams between which the recording medium with the toner image is moved. The one fixing drum facing toward the toner image is heated, the other drum presses the recording medium with the toner image against the fixing drum. The toner is then melted into the recording medium by heat and pressure of the drums.

In order to prevent toner from remaining adhering to the surface of the fixing drum, the surface thereof is moistened with parting liquid, for example silicone oil. For applying this parting liquid onto the fixing drum, German Patent Document DE-C-39 42 147 discloses a release agent application means wherein an application element composed of felt is pressed against the fixing drum by a pressing member extending along the fixing drum. A dosing tube that contains discharge openings in its longitudinal extent is provided at that side of the application element facing away from the fixing drum. Release agent, or parting oil, that is pumped into the dosing tube emerges from the openings and thus proceeds onto the application element.

In order to be able to match the moistening of the surface of the fixing drum to the width of a recording medium, a rotatable control wedge is contained in the dosing tube. More or fewer discharge openings can be closed dependent on the position of this control wedge, as a result whereof the release agent is only output to the region of the fixing drum coming into contact with the recording medium. The position of the control wedge is always matched by a motor operator to the recording medium width processed in the printer or copier device.

It has now been shown that the adaptation of the oiling width must ensue very exactly. When too much release agent is output from the release agent dosing tube, then contaminations arise in the fixing station and neighboring units of the printer or copier device. When too little release agent proceeds onto the surface of the fixing drum, then print image disturbances arise. A satisfactory printing result can therefore only be achieved when the width matching of the release agent application functions reliably.

Due to its direct contact with the heated fixing drum, however, the release agent application means is exposed to high temperatures. These high temperatures also lead to a particular load of the motor for adjusting the control wedge in the dosing tube. This motor operator therefore often fails to perform.

German Patent Document DE-A1-3941 195 also discloses a release agent application means for applying release agent to the surface of a fixing drum of an electrographic printer or copier device that comprises a pressure member extending along the fixing drum and an application element lying against guide elements of the pressure member via which release agent is applied onto the fixing drum. A cannula that can be composed of porous textile fiber material is provided axially parallel to the application element for the delivery of the release agent.

SUMMARY OF THE INVENTION

The present invention is based on the object of disclosing a release agent application means for applying release agent onto the surface of a fixing drum of an electrographic printer or copier device that can also be reliably utilized given high thermal stressing such as to assure a reliable oiling of the fixing drum without disturbance s of the print image and without contamination of the fixing station and neighboring units of the printer or copier device.

This object is achieved by a release agent applicator for applying release agent onto the surface of a fixing drum of an electrographic printer or copier device, including

- a pressure member extending along the fixing drum;
- an application element that can be brought into contact with the fixing drum and that lies against guide elements of the pressure member;
- a release agent delivery apparatus that extends in a region between the guide elements at that side of the application element facing away from the fixing drum and outputs release agent to the application element in a release agent transfer region, wherein the release agent delivery apparatus has:
  - a duct that is arranged under the release agent transfer region, so that the supplied release agent distributes therein over the usable width of the fixing drum, and a wick immersing into the duct that extends from the duct to the release agent transfer region and lies against the application element thereat. Developments and embodiments of the invention are provided by a release agent dosing tube that extends along the wick over the usable width of the fixing drum and contains discharge openings through which release agent can be output to the wick. A distance is between the release agent dosing tube and the wick, and an elastic lip bridges the distance that is coupled liquid-tight to the release agent dosing tube and is inclined in the direction toward the duct so that release agent emerging from the discharge openings can flow to the wick. The lower guide element contains the duct and an upper guide element is provided that contains an undercut longitudinal channel into which a thickened long side of the wick can be pulled.

In a preferred embodiment, the application element transportable opposite the rotational sense of the fixing drum, and comprising a duct closed at both sides that contains walls of different height, whereby the lower wall lies at the application element, so that excess release agent is output to the application element. A resilient bearing of the pressure member is also provided.

Preferably, a fleece serves as the application element, the fleece exhibiting a thickness of 0.2 mm through 0.3 mm. The fleece is composed of polyamide, polyimide or Teflon.

A reliable oiling of the fixing drum without disturbances of the print image and without contamination of the fixing station and neighboring units of the photocopier device is assured by the inventive solution even given high thermal stressing. Adjustment mechanisms are entirely foregone according to the invention. Due to the collaboration of the duct and the wick, the required amount of release agent is always available along the fixing drum. The duct contains a specific quantity of the liquid, which uniformly distributes in the duct due to the force of gravity. The release agent can be supplied to the duct at the one side either continuously or in intervals and can be taken at the other side. Preferably, however, the duct is closed at its ends.

The wick immerses into the duct over the entire longitudinal extent thereof. The wick absorbs the release agent from the duct by capillary action. This capillary action sees to it that the wick soaks up a corresponding amount of the release agent in regions in which the wick outputs a greater quantity of release agent to the application element. A good capillary action and absorbency is achieved given employment of PTFE, polyamide, polyimide and given combinations of the substances. Due to the good absorbency of the wick, this also serves as a release agent storage. A compensation to fluctuating release agent requirements can be made on the basis of these storing effects. Moreover, a non-uniform delivery of the release agent to the wick does not affect the quality of the release agent application on the fixing drum.

According to an improvement and development of the invention, the delivery of the release agent ensues directly to the wick. To that end, a release agent dosing tube extends along the wick over the usable width of the fixing drum. Release agent is output to the wick from discharge openings of the release agent dosing tube. Excess release agent proceeds from the wick into the duct. This effects an accelerated absorption of the release agent by the wick. A distance between the release agent dosing tube and the wick is preferably bridged by an elastic lip. This lip is coupled by a liquid-tight seal to the release agent dosing tube and inclined in the direction toward the duct. This lip assures that all release agent emerging from the discharge openings is conducted to the wick. Accordingly, the discharge openings are arranged above the coupling region between the release agent dosing tube and the lip.

According to a further improvement and development of the invention, the duct is a component part of the lower guide element. The upper guide element contains an undercut longitudinal channel into which a thickened longitudinal side of the wick can be pulled. As a result thereof, the wick can be pulled into the longitudinal channel of the upper guide element proceeding from one side. The undercut of this longitudinal channel assures a reliable hold on the wick in the upper guide element. Since the wick immerses into the duct at the one side and the longitudinal channel is located at the opposite side, the wick connects the lower and the upper guide element to one another.

According to a further improvement and development of the invention, the duct which is closed at both sides contains walls of different heights in its longitudinal extensions. The lower wall lies against the application element, so that excess release agent is output to the application element. When the level of parting liquid exceeds the height of the lower wall, it flows off in the direction of the application element and is absorbed and carried off by the application element. A defined overflow is thus present that cannot lead to a contamination of the fixing station and neighboring function elements of the printer or copier device as a result of the release agent dripping down.

According to a further improvement and development of the invention, the pressure member is resiliently seated. As a result of this resiliency, a tolerance compensation of the rotating fixing drum subjected to thermal load is assured relative to the release agent application means. Exact adjustment work is eliminated due to the resiliency of the pressure member relative to the fixing drum.

According to a further improvement and development of the invention, a fleece having a thickness between 0.2 through 0.3 mm serves as the application element. This fleece is significantly thinner than traditional fleeces. Polyamide, polyimide and Teflon or combinations thereof are preferably employed as the fleece material. A greater length of the fleece can be wound on a small space with the thin fleece. Given unmodified maintenance intervals, an increased fleece speed can be realized due to the increased fleece length. A higher quality of the cleaning of the fixing drum is assured as a result thereof because a blockage of the fleece by dirt can be prevented. The thin fleece enables a fast and direct oiling of the fixing drum. A particular advantage is revealed in the improved capillary action and absorbency. The transfer of the release agent to the fleece with the assistance of the wick assures an optimum wetting of the fleece independently of thermal and geometrical tolerances.

BRIEF DESCRIPTION OF THE DRAWINGS

An example of the invention is explained in greater detail below on the basis of the drawing. Thereby shown are.

DETAILED DESCRIPTION OF THE PREFERRED EMBODIMENTS

Figures 1, 2:
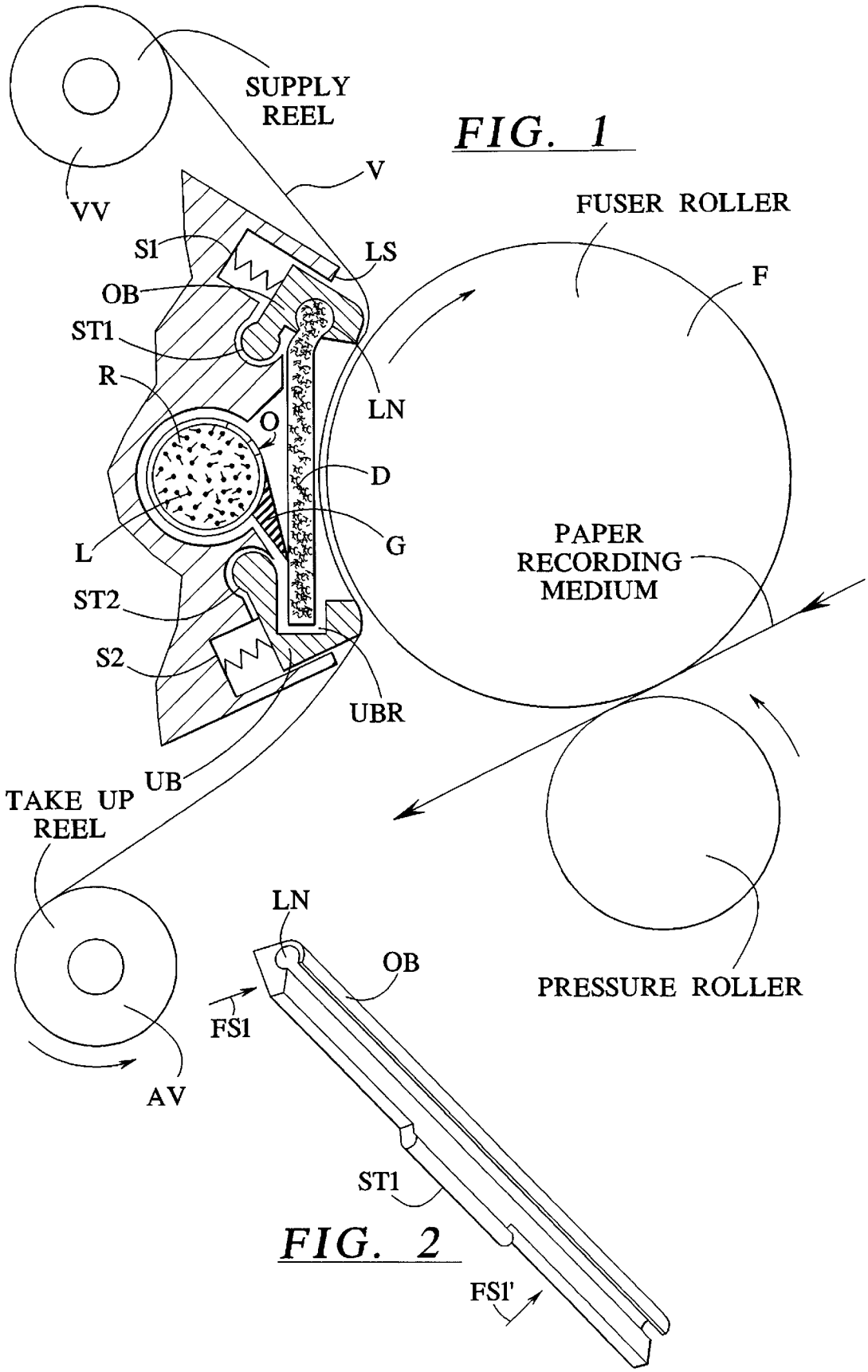
FIG. 1 is a schematic sectional view of a release agent application means with fixing drum.
FIG. 2 is a perspective view of an upper guide means according to FIG. 1.

A release agent application means (shown in FIG. 1) for applying release agent L onto the surface of a fixing drum F is allocated in a thermal fixing station in an electrographic printer or copier device that is not shown in detail here. The schematic illustration shows the fixing drum F, which rotates in a clockwise sense. The pressure drum of the fixing station and the recording medium guided between the two drums are not shown. However, the device for applying release agent onto the surface of the fixing drum F is shown. A fleece that exhibits a thickness of 0.2 through 0.3 mm serves as an application element V. It is composed of polyamide, polyimide or Teflon. The application element V applies silicone oil or some other suitable, heat resistant release agent onto the entire surface of the fixing drum F, preferably in a liquid form. In order to assure this, the application element V has its entire width extending over the entire axial length of the fixing drum F. Over and above this, the application element is applied against the fixing drum F in a pre-determined circumferential region.

In the operating condition, the application element V is constantly in contact with the surface of the fixing drum F. The application element V thereby picks up dirt particles such as, for example, toner particles or dust entrained by the recording medium. In order to assure a faultless function, the region of the application element V lying against the fixing drum F is preferably renewed in sections either continuously slowly but potentially also in chronological intervals. To that end, a supply reel VV from which the application element V is unwound as well as a take-up reel AV that winds up the used application element V is provided. The take-up reel AV is driven, for example, by a motor MO. The transport direction of the application element V produced by the motor MO runs opposite the motion of the fixing drum F, so that the used application element V entrains all contaminants picked up by being stripped from the surface of the fixing drum F, and an adequate surface of relatively fresh application element V is always available.

The circumferential region at which the application element V resides contacts with the surface of the fixing drum F is defined by the spacing of two guide elements OB and UB extending parallel to one another in an axial direction of the fixing drum F. These guide elements UB and OB are arranged vertically above one another, so that they can be identified as an upper guide element OB and a lower guide element UB. The two guide elements UB and OB are pressed to the surface of the fixing drum F by springs S1 and S2 that are arranged in the region of the end faces of the guide elements UB and OB. The arrangement of the springs S1 and S2 and their action direction is illustrated by arrows FS1 and FS1' in FIG. 2. In the middle of their longitudinal extent, the guide elements UB and OB respectively comprise a rib ST1 and ST2. These ribs ST1 and ST2 are seated so as to be captive in the chassis of the fixing station by a positive lock. The positive lock is implemented such that, on the one hand, an adequate location stability of the guide elements UB and OB is assured and, on the other hand, adequate play is present that allows the guide elements UB and OB to be pressed against the surface of the fixing drum with the springs S1 and S2 over their entire longitudinal extent. This assures a uniform planar pressing of the application element V against the surface of the fixing drum F independently of thermal and geometrical tolerances. Oscillation of the guide elements UB and OB, which is made possible by the aforementioned play in the mounting and the springs S1 and S2, thereby assures a uniform distribution of the release agent L.

The guide elements UB and OB fulfill a further task in addition to their guide function for the application element V. A thickened longitudinal side LS of a wick D can be pulled into an undercut longitudinal channel LN extending in the upper guide element OB. The wick preferably extends over the entire length of the guide elements UB and OB. The long side of the wick D lying opposite the thickened longitudinal side LS immerses into a duct UBR that extends longitudinally in the lower guide element UB. The duct UBR is open at the side facing toward the upper guide element OB. The longitudinal channel LN and the duct UBR proceed parallel to one another. Their vertical spacing from one another approximately corresponds to the width of the wick D. Thus, the wick D hangs essentially without wave formation or undulations, similar to a hanging cloth, from the upper guide element OB into the duct UBR of the lower guide element UB. The arrangement of the longitudinal channel LN and the duct UBR is selected such that the wick D contacts the application element V over the entire longitudinal extent. This assures a supply of the application element V with the release agent L that is output by the wick D.

The wick D picks up the release agent L at two locations. First, the wick D extending into the duct UBR sucks up the release agent L that is present there by capillary action. The capillary action and absorbency for a good distribution of the release agent L is promoted by employing suitable wick materials such as PTFE, polyamide and polyimide and their combinations. The good capillary action also assures that an adequate quantity of this release agent is always available in regions along the longitudinal extent of the fixing drum F in which an elevated consumption of the release agent L ensues. The duct UBR that is closed at both end faces to form a trough shaped space supports the distributing effect of the release agent L. The release agent L can flow very rapidly in the duct to the regions of the fixing drum F which require a greater quantity of the release agent, where it can be picked up from the duct by the wick D on a short path to the drum surface.

The actual release agent delivery ensues with a release agent dosing tube R. This release agent dosing tube R extends in the axial direction of the. fixing drum F in the region near that side of the wick D facing away from the fixing drum F. Openings O from which release agent L can emerge are introduced at defined intervals in that tube wall facing toward the wick D. The release agent dosing tube R is preferably closed at one end and receives release agent L at the open side via a delivery system fashioned, for example, of a hose and a pump, the release agent L being only capable of emerging from the openings O in the direction of the wick.

In order to assure a loss-free delivery of the release agent L emerging from the openings O to the wick D, an elastic lip is glued on the surface of the release agent dosing tube R in a region under the openings O. This elastic lip G bridges a distance between the release agent dosing tube R and the wick D over the entire longitudinal extent thereof. The elastic lip G has its free end lying against the wick D under pre-stress. The lip G is preferably inclined in the direction of the duct UBR, this assuring a fast flow of the release agent L.

The lower guide element UB, which contains the duct UBR, is implemented such that the duct wall that proceeds in the region of the application element V is lower than the wall at the tube side. Excess release agent L thus does not flow off at the tube side but toward the application element V. The application element V picks up the excess release agent L, which is thus carried off.

Although other modifications and changes may be suggested by those skilled in the art, it is the intention of the inventors to embody within the patent warranted hereon all changes and modifications as reasonably and properly come within the scope of their contribution to the art.

What is claimed is:

1. A release agent applicator for applying release agent onto a surface of a fixing drum of an electrographic printer or copier device, comprising a pressure member extending along the fixing drum, said pressure member including guide elements;

an application element in contact with the fixing drum, said application element lying against the guide elements of the pressure member;

a release agent delivery apparatus that extends in a region between the guide elements at a side of the application element facing away from the fixing drum and applies release agent to the application element in a release agent transfer region, said release agent delivery apparatus including:

a duct arranged under the release agent transfer region along which the release agent is distributed so that the release agent distributes therein over a usable width of the fixing drum, and a wick immersing into the duct that extends from the duct to the release agent transfer region and lies against the application element at the release agent transfer region.

2. A release agent applicator according to claim 1, further comprising:

a release agent dosing tube that extends along the wick over the usable width of the fixing drum and has discharge openings through which the release agent is output to the wick.

3. A release agent applicator according to claim 2, wherein said release agent dosing tube and the wick are spaced apart by a distance, and further comprising:

an elastic lip bridging the distance that is coupled liquid-tight to the release agent dosing tube and is inclined in a direction toward the duct so that release agent emerging from the discharge openings flows to the wick.

4. A release agent applicator according to claim 1, wherein said wick has a thickened long side, and wherein said guide elements include a lower guide element that contains the duct;

an upper guide element defining an undercut longitudinal channel into which extends said thickened long side of the wick.

5. A release agent applicator according to claim 1, further comprising:

a transport for moving said application element in a direction opposite a rotational sense of the fixing drum, and wherein said duct is closed at both sides and has walls of different height, a lower one of said walls being adjacent the application element so that the excess release agent is applied to the application element.

6. A release agent applicator according to claim 1, wherein said pressure member includes a resilient bearing.

7. A release agent applicator according to claim 1, wherein said application element includes a fleece, said fleece being of a thickness of 0.2 mm through 0.3 mm.

8. A release agent applicator according to claim 7, wherein said fleece is of a material selected from polyamide, polyimide and Teflon.

9. A release agent applicator for applying release agent onto a surface of a fixing drum of an electrographic printer or copier device, comprising:

a release agent dosing member extending generally parallel to and spaced from the fixing drum, said release agent dosing member carrying a release agent in an interior space of said release agent dosing member, said release agent dosing member including a plurality of openings into said interior space at positions along a length of said release agent dosing member, said openings being at a side of said release agent dosing member generally facing toward the fixing drum;

a release agent dispersing apparatus positioned below said openings to receive the release agent emitted by said openings, said release agent dispersing apparatus including a duct in which the release agent flows to disperse the release agent; and an application element positioned adjacent the fixing drum, said application element conveying the release agent from the release agent dispersing apparatus to the fixing drum.

10. A release agent applicator as claimed in claim 9, wherein said application element is between said release agent dispensing apparatus and the fixing drum.

* * * * *